US007730581B2

(12) United States Patent
Mirick

(10) Patent No.: US 7,730,581 B2
(45) Date of Patent: Jun. 8, 2010

(54) WELD-ON BARREL HINGE

(75) Inventor: Larry Mirick, Manhattan Beach, CA (US)

(73) Assignee: S.P.E.P. Acquisition Corp., Rancho Dominquez, CA (US)

( * ) Notice: Subject to any disclaimer, the term of this patent is extended or adjusted under 35 U.S.C. 154(b) by 309 days.

(21) Appl. No.: 12/075,325

(22) Filed: Mar. 10, 2008

(65) Prior Publication Data

US 2008/0172832 A1 Jul. 24, 2008

(51) Int. Cl.
*E05D 11/00* (2006.01)

(52) U.S. Cl. ..... 16/273; 16/274; 16/386

(58) Field of Classification Search ..... 16/273, 16/274, 261–263, 386, 229–231; 403/292–294, 403/121, 119
See application file for complete search history.

(56) References Cited

U.S. PATENT DOCUMENTS 132,147 A * 10/1872 Dodge ..... 16/274
470,514 A * 3/1892 Simpson ..... 285/382.2
853,507 A * 5/1907 Fielding ..... 16/329
1,433,095 A * 10/1922 Peary ..... 16/274
4,307,486 A * 12/1981 Matsumoto ..... 16/261
4,573,239 A * 3/1986 Valenti et al. ..... 16/273
4,713,861 A * 12/1987 Bancroft ..... 16/222
5,561,886 A * 10/1996 Flamme ..... 16/265
5,771,538 A * 6/1998 Huppert, Sr. ..... 16/274
5,774,938 A * 7/1998 Kent et al. ..... 16/332
6,460,220 B1 * 10/2002 Jackson ..... 16/285
2008/0034542 A1 * 2/2008 Lee ..... 16/342

* cited by examiner

*Primary Examiner*—William L. Miller
(74) *Attorney, Agent, or Firm*—Christie, Parker & Hale, LLP

(57) ABSTRACT

A weld-on barrel hinge having a female barrel portion and two male barrel portions for hinging together two items. The cylindrical female barrel portion has an axial bore formed therethrough. The cylindrical female barrel portion is welding to a first item. The male barrel portions have a cylindrical main body portion and a pin extension that is sized to be rotatably received within the axial bore of the female barrel portion. A passageway formed in at least one of the male barrel portions has a first end that opens in the cylindrical main body portion, and at least one second end that opens in the pin extension. The male barrel portions are inserted in the female barrel portion and are welded to a second item. A lubricant fitting is affixed to first end of the passageway in the at least one male barrel portion.

18 Claims, 12 Drawing Sheets

WELD-ON BARREL HINGE

CROSS-REFERENCE TO RELATED APPLICATION(S)

This application contain subject matter related to U.S. patent application Ser. No. 10/080,818, filed on Feb. 22, 2002, to be issued on Mar. 11, 2008, as U.S. Pat. No. 7,340,800, the contents of which are hereby incorporated by reference.

BACKGROUND OF THE INVENTION

The invention relates to hinges, and more particularly, to barrel hinges.

Barrel hinges are widely used in applications that require hingeably attaching heavy structures together, such as ingress and egress ramps for horse trailers, ramps for earth-moving equipment trailers, doors for ocean shipping containers, and the like.

In order to provide for lubrication of barrel hinges, grease fittings can be included in the hinge designs by being attached to ends of a shaft, with a grease channel provided through the shaft so that grease can be released between the pin and the sleeve. However, for long barrel hinges, it can be costly and difficult to bore a grease channel through the pin for delivery of grease between the pin and the sleeve of the barrel hinge.

Prior art barrel hinges having three sleeve sections have been made by providing three separate sleeves made of seamless tubing and an elongate rod which is retained within bores of the sleeves. Once assembled, the two end sleeves are welded at their ends to the ends of the rod, leaving the intermediate sleeve to freely rotate. These welds require additional labor and are more prone to corrosion than the unwelded portions. These prior designs do not lend themselves to lubrication by use of the grease fitting and therefore requires manual frequent lubrication, or more typically, remain unlubricated. Furthermore, seamless tubing is more costly than seamed tubing.

Accordingly, there remains a need for an improved barrel hinge that is easier to manufacture and maintain, is less prone to rust, has better lubrication properties, and has more consistent quality.

DETAILED DESCRIPTION OF THE INVENTION

Figure 1:
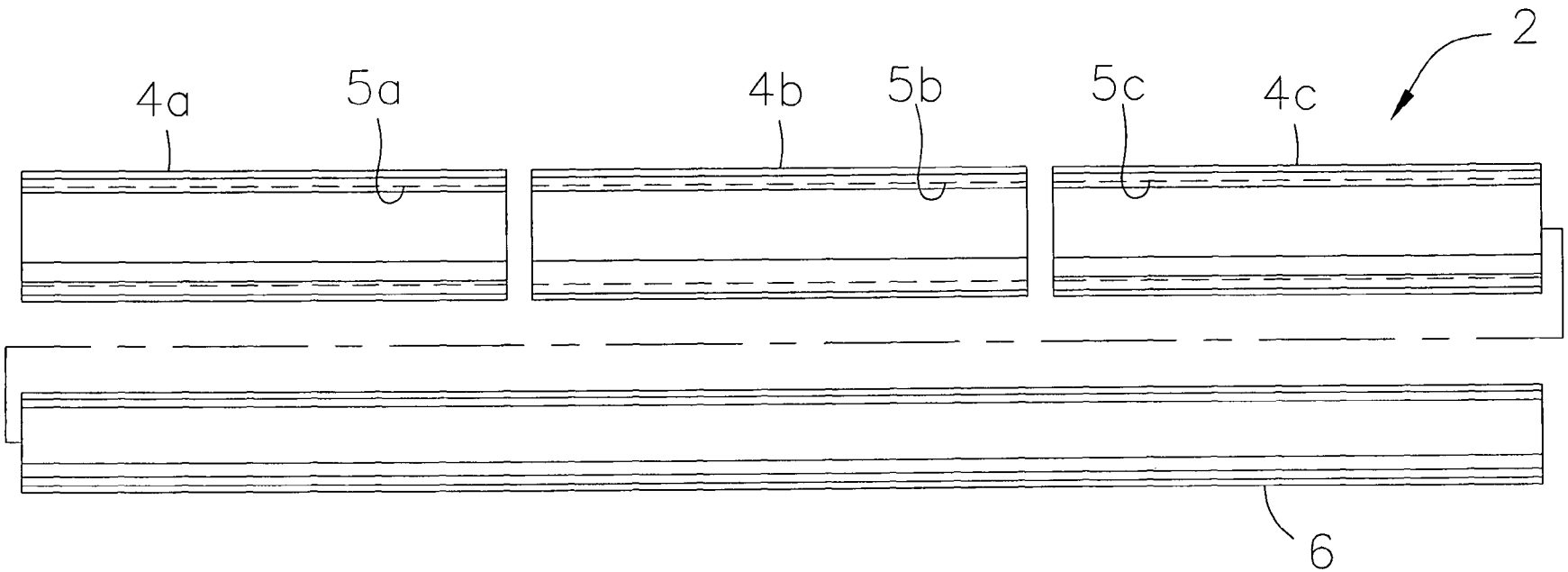
FIG. 1 PRIOR ART
FIG. 1 is an exploded view of a prior art four-piece barrel hinge design.

Referring to FIG. 1, there is shown an exploded view of a prior art four-piece barrel hinge design, having three tube sections 4*a*, 4*b* and 4*c*, and a central pin 6 which is sized to be received within axial openings 5*a*, 5*b*, and 5*c* of the sleeves 4*a*, 4*b* and 4*c*.

Figure 2:
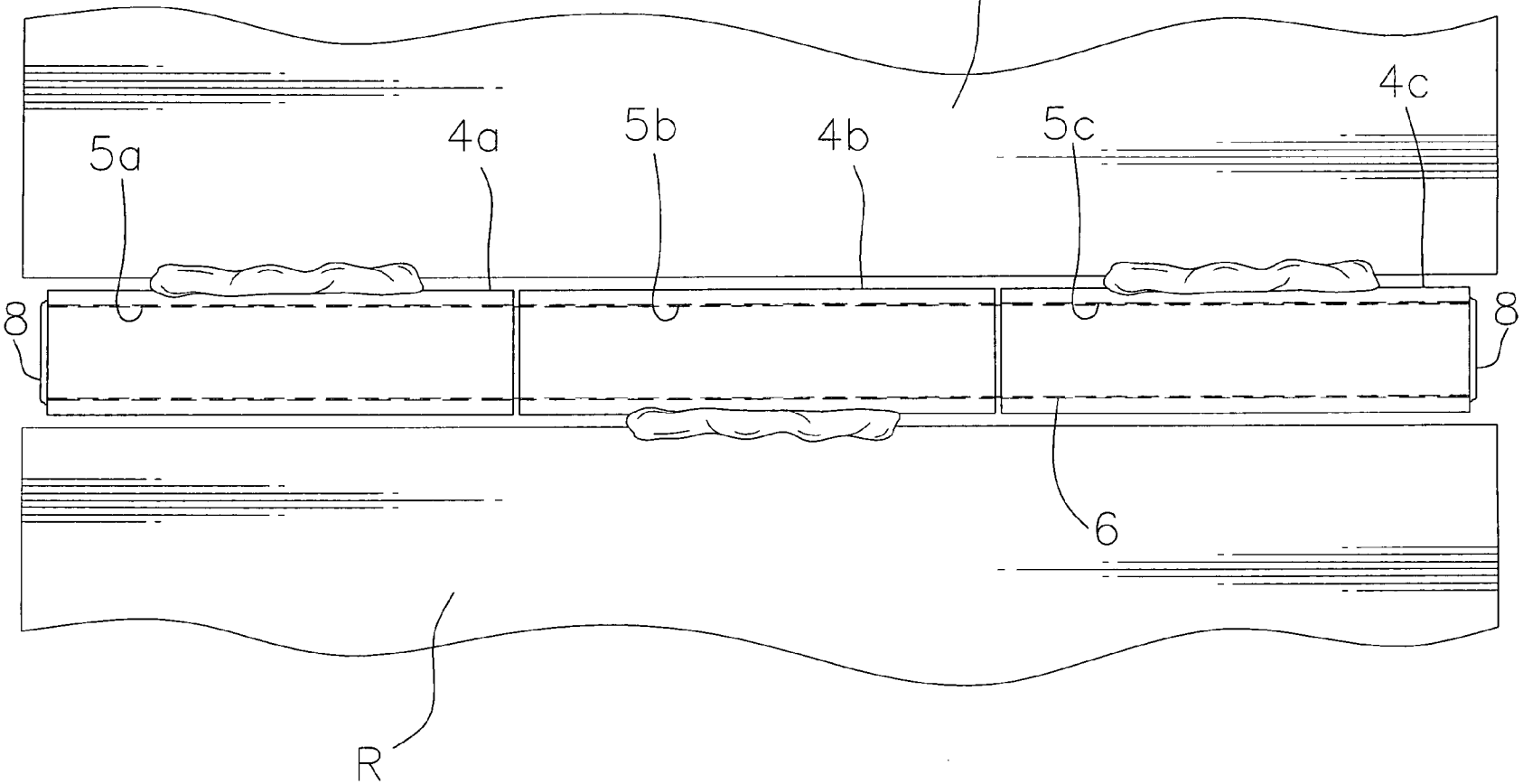
FIG. 2 PRIOR ART
FIG. 2 is a view showing the assembled prior art barrel hinge of FIG. 1, attached to two parts that are hinged together.

FIG. 2 shows pin 6 placed through axial openings 5*a*, 5*b* and 5*c* of sleeves 4*a*, 4*b* and 4*c*, with sleeves 4*a* and 4*c* being welded at their ends 8 to pin 6 to secure same together, and with barrel hinge 2 being welded to a first portion to be hinged together (e.g., a trailer (T)) and a second portion to be hinged together (e.g., a ramp thereof (R)). Pin 6 can be welded to sleeves 4*a* and 4*c* prior to attachment of the barrel hinge to the trailer and ramp, or another application. The welds 8 not only require additional assembly time, but also are more prone to rust and corrosion than unwelded areas. Furthermore, the prior art four-piece barrel hinge require that the sleeves 4*a*, 4*b*, and 4*c* be made from seamless tubing, which is more costly than seamed tubing, or utilize seamed tubing that has been machined on an inside surface thereof to remove the weld line (which can weaken the tubing). In order to provide for lubrication, a grease fitting can optionally be provided in an end of pin 6 with the grease hole formed therethrough which egresses at one or more points in the vicinity of the interface between sleeve 4*b* and the surface of pin 6 (not shown). However, this requires formation of a long channel through the center of rod which can weaken the rod and requires additional manufacturing steps. If typical grease fittings are threaded into a sidewall of the sleeve, they jut beyond the inner surface of the axial opening in the sleeve and impinge on the pin. It is therefore problematic to use grease fittings in the prior art designs. Furthermore, there is no grease reservoir provided in the prior art design since the most grease that can be retained is limited by the volume available between pin 6 and inner walls of sleeve 4*b*, which for close fitting pins and sleeves, is very small.

Figures 3, 4:
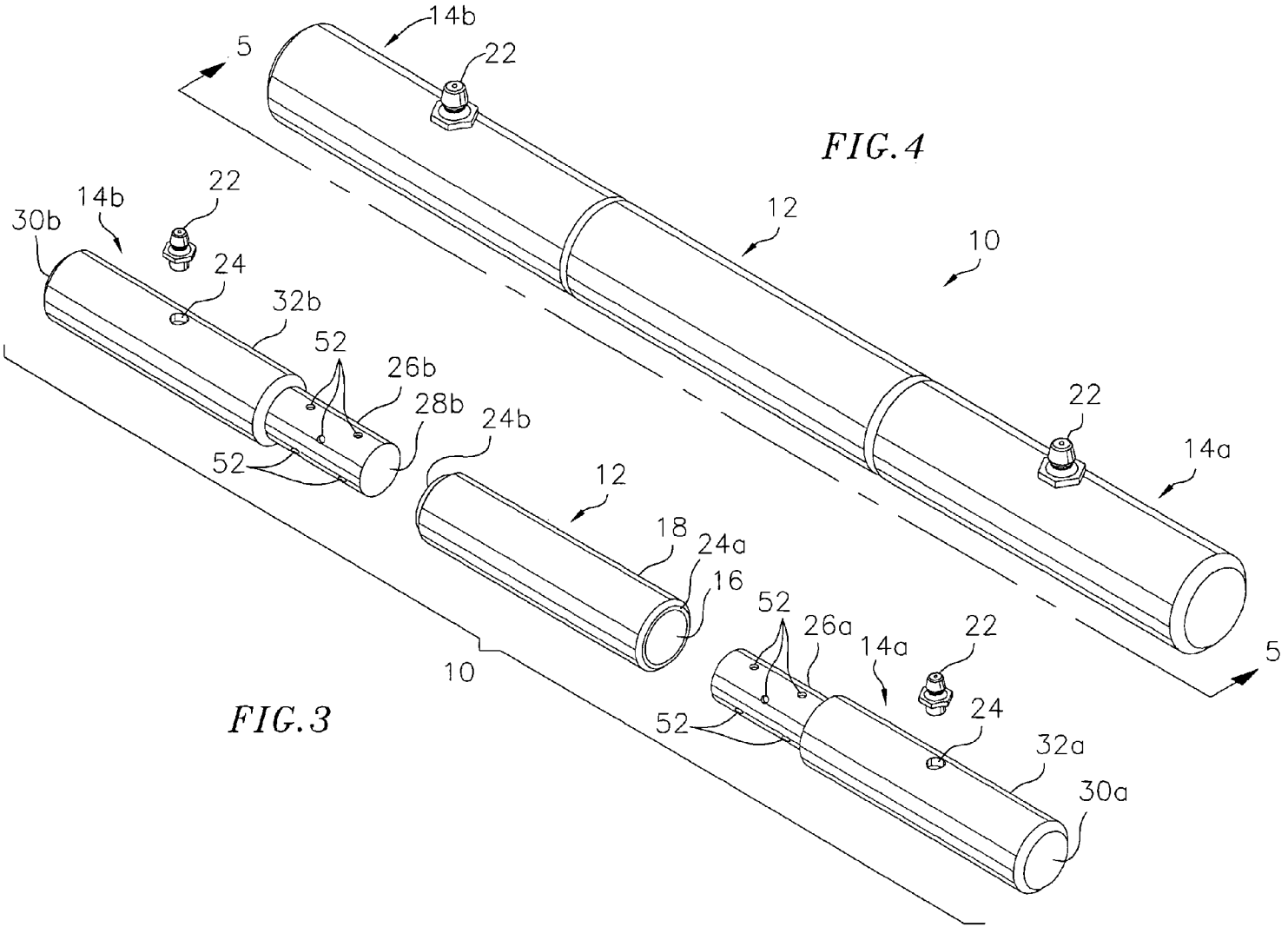
FIG. 3 is an exploded perspective view of an exemplary embodiment of a three-piece barrel hinge of the invention.
FIG. 4 is a perspective view of the assembled three-piece barrel hinge of FIG. 3.

Turning to FIG. 3, there is shown an exploded view of an exemplary embodiment of a three-piece barrel hinge of the invention 10, which includes a female barrel 12, and two male barrels 14*a* and 14*b*. Female barrel 12 has a cylindrical and axially located bore 16 formed therethrough from end to end (24*a* through 24*b*). Female barrel 12 has an outer surface 18. Female barrel 12's bore 16 has a predetermined interior diameter. Male barrels 14*a* and 14*b* have cylindrical pin extension 26*a* and 26*b* having front faces 28*a* (Shown in FIG. 5) and 28*b*, the diameter of which is slightly smaller than that of the interior diameter of opening 16. Male barrels 14*a* and 14*b* have opposite ends 30*a* and 30*b*, and have exterior surfaces

32*a* and 32*b* which were available for welding. Male barrels 14*a* and 14*b* are preferably identical. Outer surface 18 of female barrel 12 is likewise available for welding to another structure. The male barrels 14*a* and 14*b* preferably have a threaded orifice 24 formed therein for receiving a grease fitting 22 therein. The threaded orifice communicates with a channel 50 formed through the axis of the male barrels. Intersecting and in communication with the channel 50 are side channels 52 that are formed to open into the sidewall of the cylindrical pin extension 26*a* and 26*b*.

Referring to FIG. 4, there is shown a perspective view showing the three-piece barrel of the invention with pin extensions male barrels 14*a* and 14*b* inserted into the opening of female barrel 12 and with grease fittings 22 engaged with threaded opening 24 of male barrel portions 14*a* and 14*b*.

Figure 5:
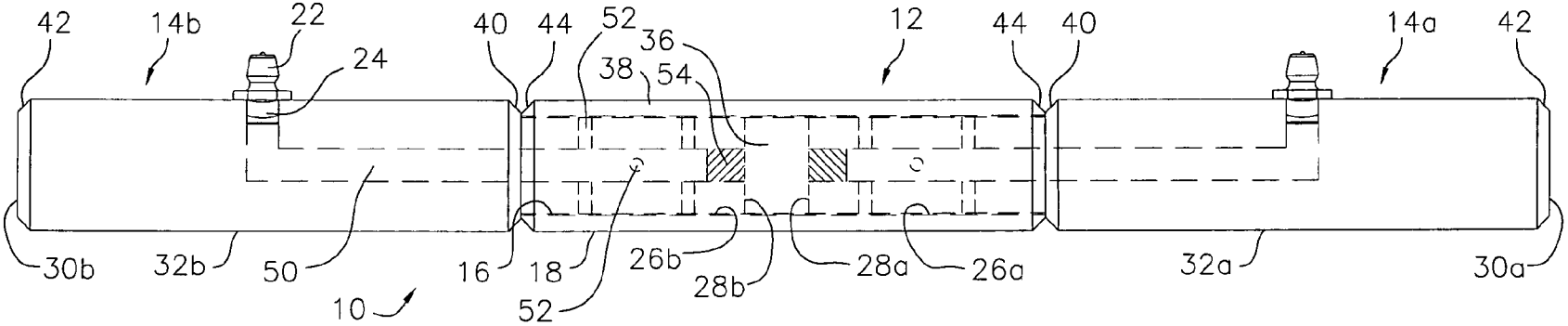
FIG. 5 is a cross-sectional view of the three-piece barrel hinge of FIG. 4 through view lines 5-5.

Turning to FIG. 5, there is shown a partial cross-sectional view through view lines 5-5 of FIG. 4, showing the assembled three-piece barrel hinge, with the female barrel 12 and male barrels 14*a* and 14*b* exposed. As can be seen, ends 28*a* and 28*b* of pin extensions 26*a* and 26*b*, respectively, are spaced apart from each other and define a cavity 36 therebetween within female barrel 12. This cavity 36 may act as a grease reservoir. The channels 50 can be drilled through end faces 28*a* and 28*b* and blocked with plugs 54, if desired. The side channels 52 can be dilled through the side walls of the pin extensions 26*a* and 26*b* to intersect the channels 50. Thus, grease inserted through the grease fittings 22 will be forced though channels 50 and side channels 52 to lubricate the region between the pin extensions and the inside wall 38 of the female portion 12. Excess grease or other lubricant will tend to move to cavity 36, which will become available for lubrication. If the grease fittings 22 and/or bores 24 become damaged, the grease fittings 22 can be replaced and/or hole 24 can be rethreaded without requiring removal of the barrel hinge from the trailer to which it is welded.

Figure 7:
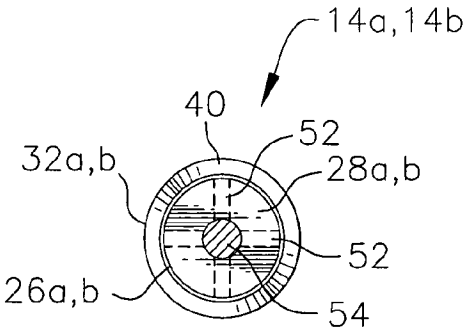
FIG. 7 is an end view of the male portion of the three-piece barrel hinge of FIG. 6 along view lines 7-7.
Figure 6:
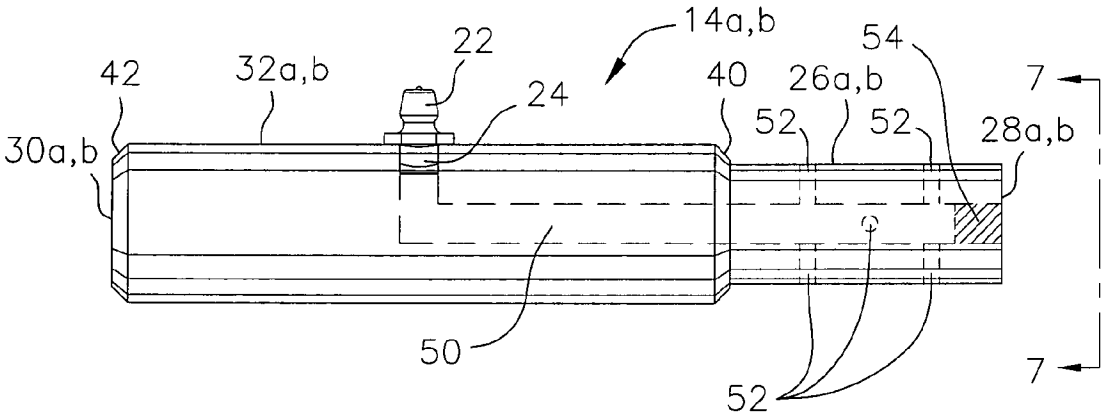
FIG. 6 is a cross-sectional view of a male portion of the three-piece barrel hinge of FIG. 5.

Turning to FIGS. 6 and 7, there is shown a cross-sections view and end view of the male barrels 14*a* and 14*b*. At an interface of outer surface 32*a* and 32*b* and pin extension 26*a* and 26*b*, edges thereof 40 are preferably slightly beveled to provide a paint retention surface such that when the three piece barrel hinge is fully assembled as shown in FIGS. 4 and 5, contact between female barrel 12 and male barrels 14*a* and 14*b* will not cause paint to excessively chip off along edges 40, thereby improving the appearance of the painted hinge installed. Ends 30*a* and 30*b* can also preferably be beveled 42. The grease fitting 22, threaded opening 24, channel 50, side channels 52, and plug 54 are shown. While the exemplary embodiment of FIGS. 4-7 show the grease fittings 22 as being on the outer surface of the generally cylindrical main body portions 32*a* and 32*b*, they can be located on the end walls 30*a* and 30*b*, as shown in the embodiment of FIGS. 14-18, if desired.

Figure 8:
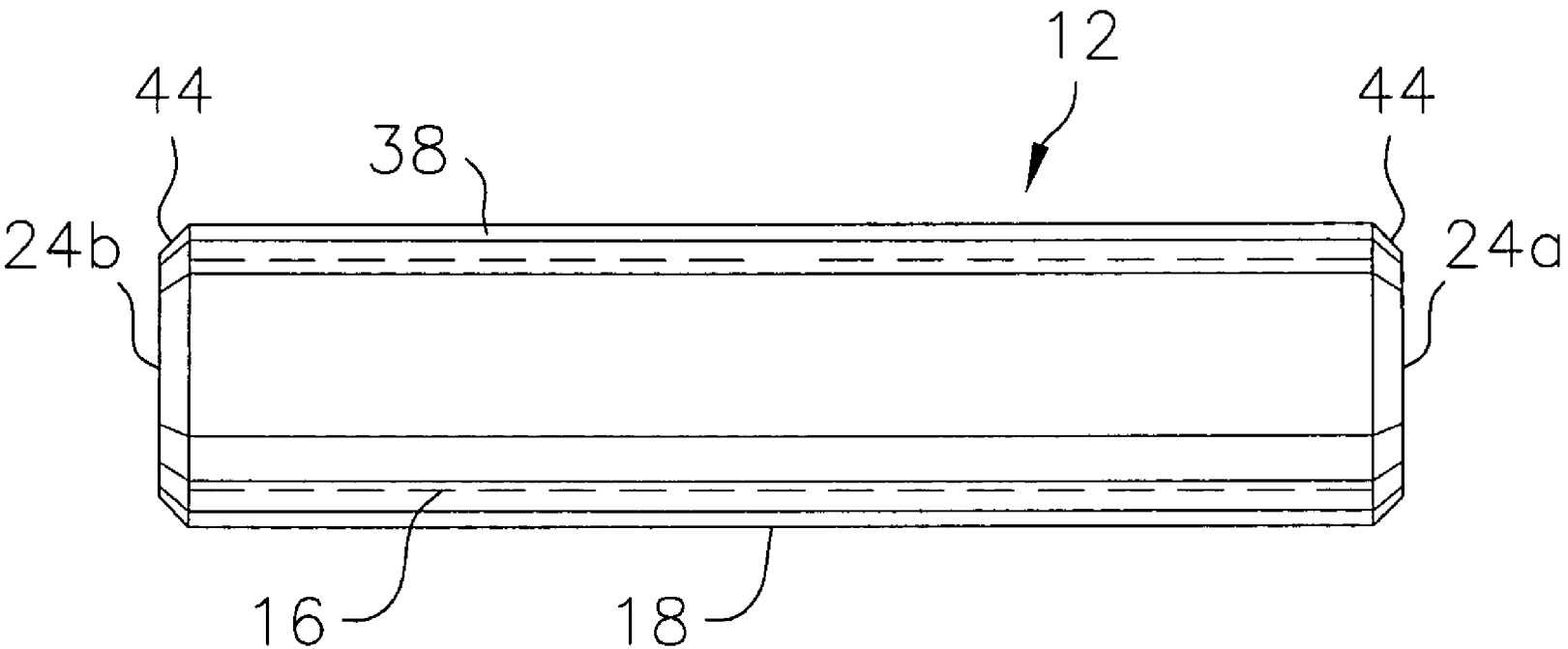
FIG. 8 is a side view showing the female portions of the three-piece barrel hinge of FIGS. 3-5.

FIG. 8 is a side view showing the female portion 12 of the three-piece barrel hinge of FIGS. 3-5. Its outer surface 18, ends 24*a, b*, inner-diameter 16, and wall 38 are shown. It has bevels 44 at its ends, which together with the bevels 40 of the male portions 14*a, b* (shown in FIG. 5) function as described above. The outer edges 44 of female barrel 12 are also preferably beveled slightly so that when female barrel 12 is assembled with male barrels 14*a* and 14*b*, there is less likelihood of paint chipping along edges 40 and 42, which will provide for an improved paint longevity of the device.

FIGS. 9-13 are views of another exemplary embodiment of a three-piece barrel hinge 60 of the invention. It is similar to the three-piece barrel hinge 10 of FIGS. 3-8, and similar reference numerals are used, except as otherwise noted, and instead of having the lubricant pass from the main channels 50 to side channels 52, grease will pass directly from the main channel 50 to a grease reservoir 36 that will be defined by the space in the female portion 62 and ends 28*a* and 28*b* of two male barrels 64*a* and 64*b*, respectively.

Figures 9, 10:
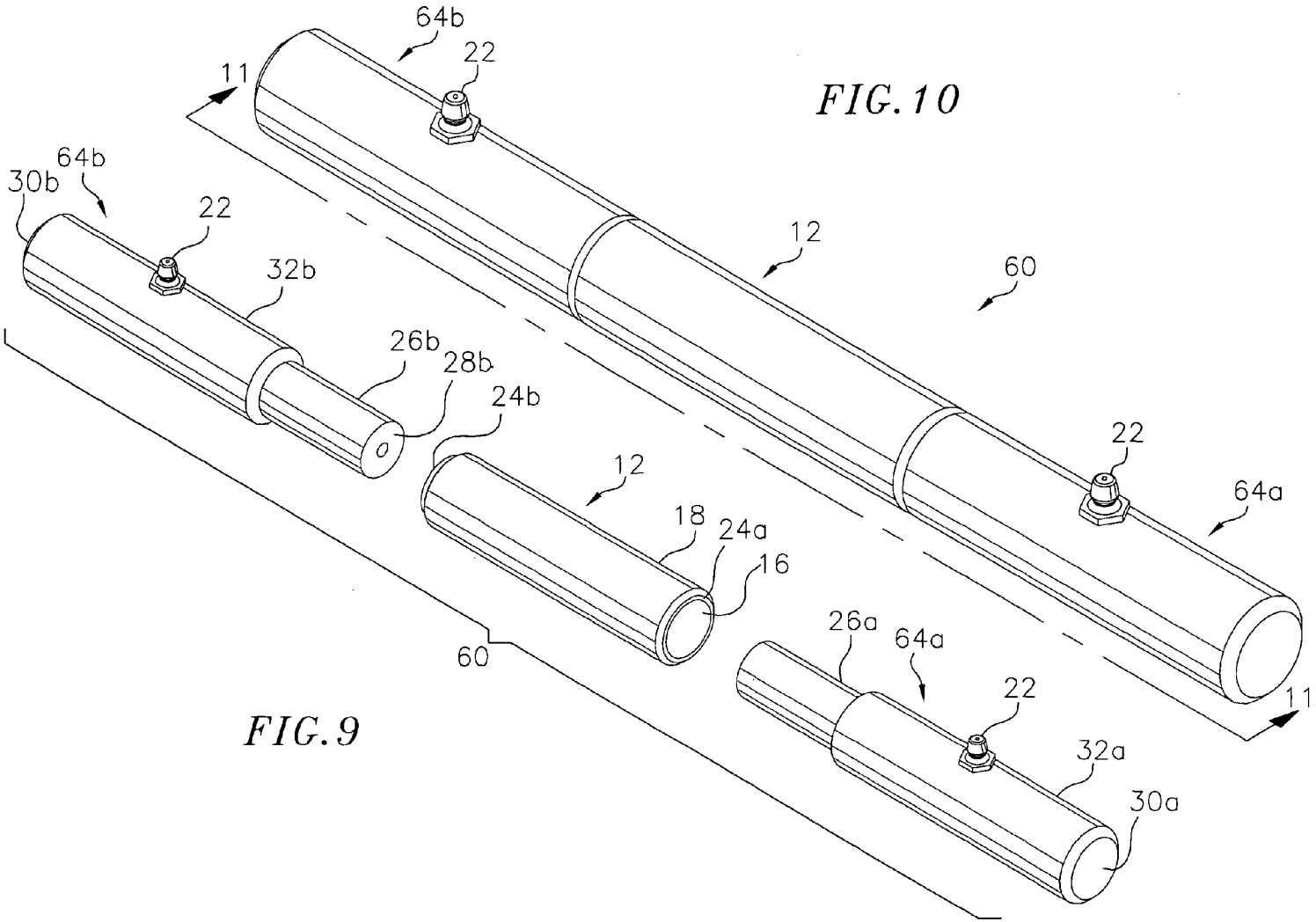
FIG. 9 is an exploded perspective view of another exemplary embodiment of a three-piece barrel hinge of the invention.
FIG. 10 is a perspective view of the assembled three-piece barrel hinge of FIG. 9.

FIG. 9 is an exploded perspective view of the three-piece barrel hinge 60 of the invention. Female barrel has a cylindrical and axially located bore 16 formed therethrough from end to end (24*a* through 24*b*). Female barrel has an outer surface 18. Female barrel 62's bore 16 has a predetermined interior diameter. Male barrels 64*a* and 64*b* have cylindrical pin extension 26*a* and 26*b* having front faces 28*a* (shown in FIG. 13) and 28*b*, the diameter of which is slightly smaller than that of the interior diameter of opening 16. Male barrels 64*a* and 64*b* have opposite ends 30*a* and 30*b*, and have exterior surfaces 32*a* and 32*b* which are available for welding. Male barrels 64*a* and 64*b* are preferably identical. Outer surface 18 of female barrel 62 is likewise available for welding to another structure. The male barrels 64*a* and 64*b* preferably have a threaded opening (not shown) formed therein for receiving a grease fitting 22 therein. The threaded orifice communicates with a channel 50 formed through the axis of the male barrels.

FIG. 10 is a perspective view of the assembled three-piece barrel hinge 60 of FIG. 9, with the pin extensions male barrels 64*a* and 64*b* inserted into the opening of female barrel 62 and with grease fittings 22 engaged with threaded opening 24 of male barrel portions 64*a* and 64*b*.

Figure 11:
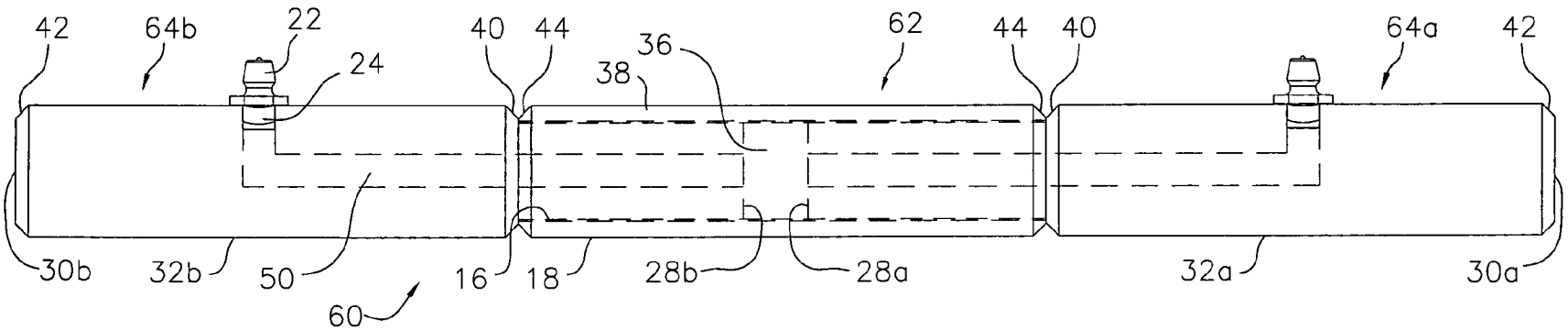
FIG. 11 is a partially exposed side view of the three-piece barrel hinge of FIG. 10.

FIG. 11 is a partially exposed side view of the three-piece barrel hinge 60 of FIG. 10, showing the assembled three-piece barrel hinge 60, with the female barrel 62 and male barrels 64*a* and 64*b* exposed. As can be seen, ends 28*a* and 28*b* of pin extensions 26*a* and 26*b*, respectively, are spaced apart from each other and define a cavity 36 therebetween within female barrel 62. This cavity 36 may act as a grease reservoir. The channels 50 can be drilled through end faces 28*a*, 28*b*. Thus, grease inserted though the grease fittings 22 will be forced though channels 50 and into the central grease reservoir 36 to lubricate the region between the pin extensions and the inside wall 38 of the female portion. If the grease fittings 22 and/or bores 24 become damaged, the grease fittings 22 can be replaced and/or hole 24 can be rethreaded without requiring removal of the barrel hinge from the trailer to which it is welded.

Figure 13:
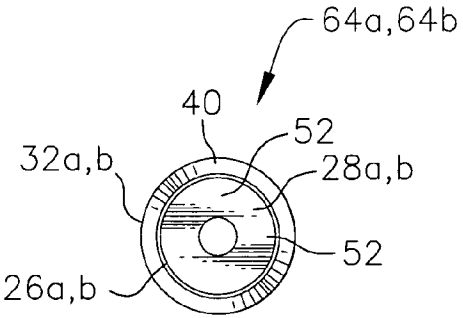
FIG. 13 is an end view of the male portion of the three-piece barrel hinge of FIG. 12 shown along view lines 13-13.
Figure 12:
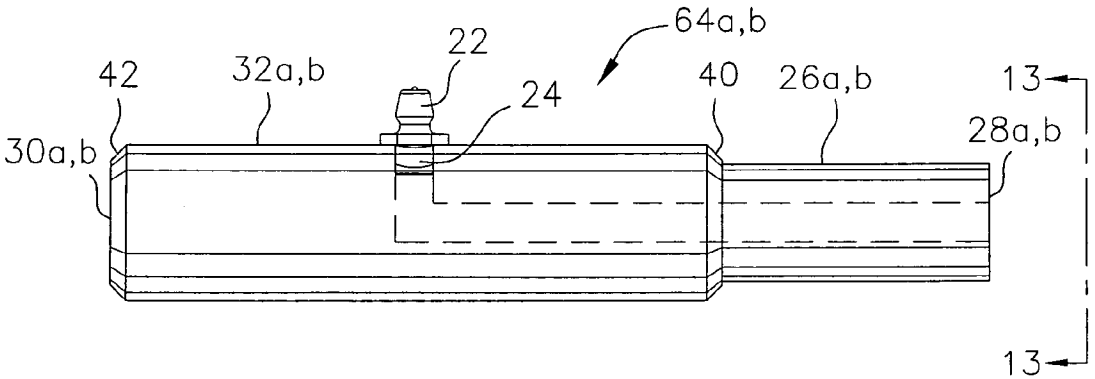
FIG. 12 is a partially exposed side view of the male portions of the three-piece barrel hinge of FIGS. 9-11.

FIG. 12 is a partially exposed side view of the male portions of the three-piece barrel hinge of FIGS. 9-11. Turning to FIGS. 12 and 13, there is shown a cross-sectional view and an end view of the male barrels 64*a* and 64*b*. At an interface of outer surface 32*a* and 32*b* and pin extension 26*a* and 26*b*, edges thereof 40 are preferably slightly beveled to provide a paint retention surface such that when the three piece barrel is fully assembled as shown in FIGS. 10 and 11, contact between female barrel 62 and male barrels 64*a* and 64*b* will not cause paint to excessively chip off along edges 40, thereby improving the appearance of the painted hinge installed. Ends 30*a* and 30*b* can also preferably be beveled 42. The grease fitting 22, threaded opening 24, and channel 50 are shown. While the exemplary embodiment of FIGS. 9-13 show the grease fittings as being on the outer surface of the generally cylindrical main body portions, they can be located on the end walls, as shown in the embodiment of FIGS. 14-18, if desired.

Figures 14, 15:
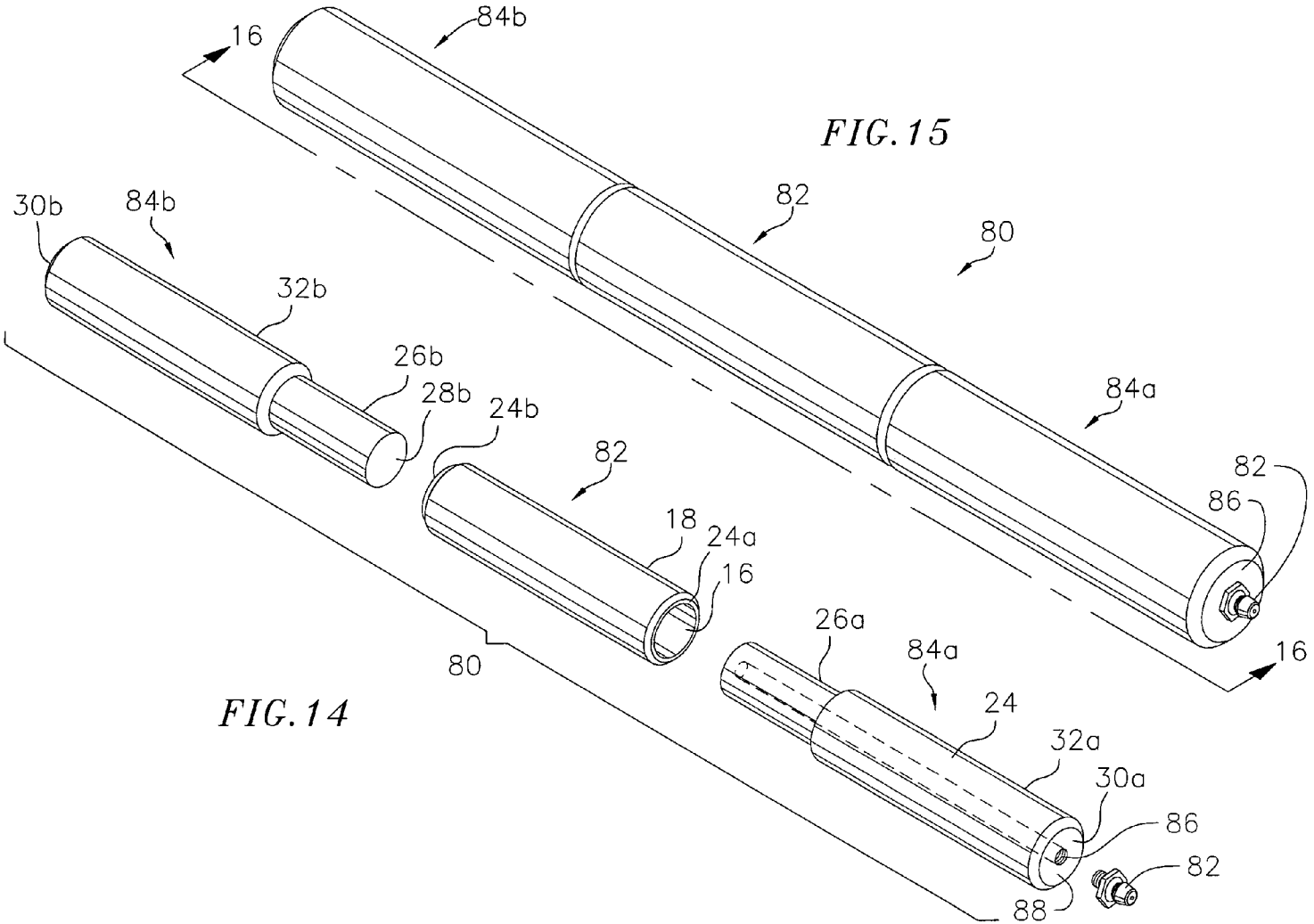
FIG. 14 is an exploded perspective view of a further exemplary embodiment of a three-piece barrel hinge of the invention.
FIG. 15 is a perspective view of the assembled three-piece barrel hinge of FIG. 14.
Figure 16:
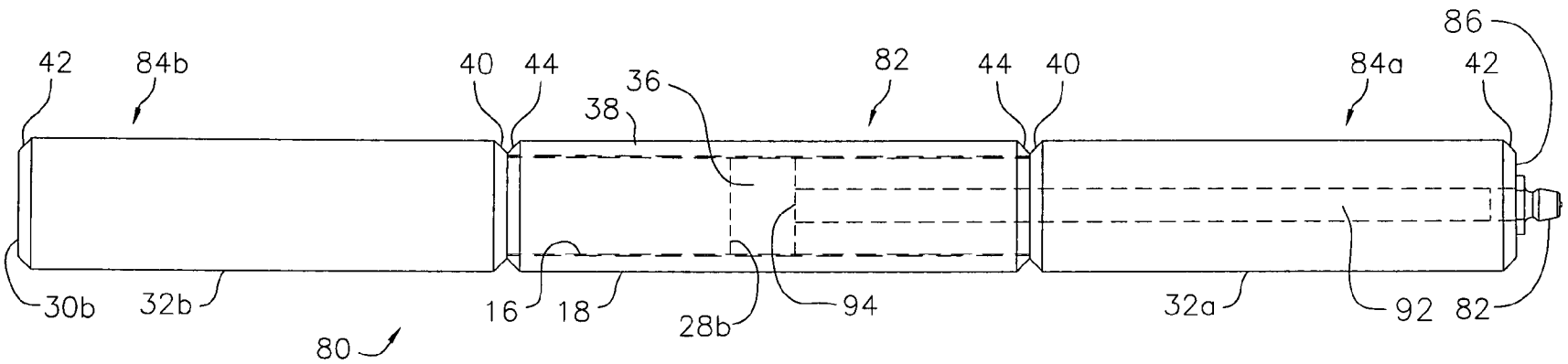
FIG. 16 is a partially exposed side view of the three-piece barrel hinge of FIG. 15.
Figure 18:
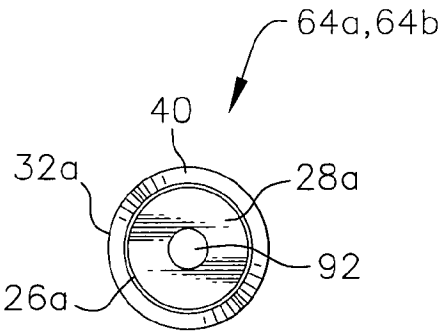
FIG. 18 is an end view of the male portion of the three-piece barrel hinge of FIG. 6 along view lines 7-7.
Figure 17:
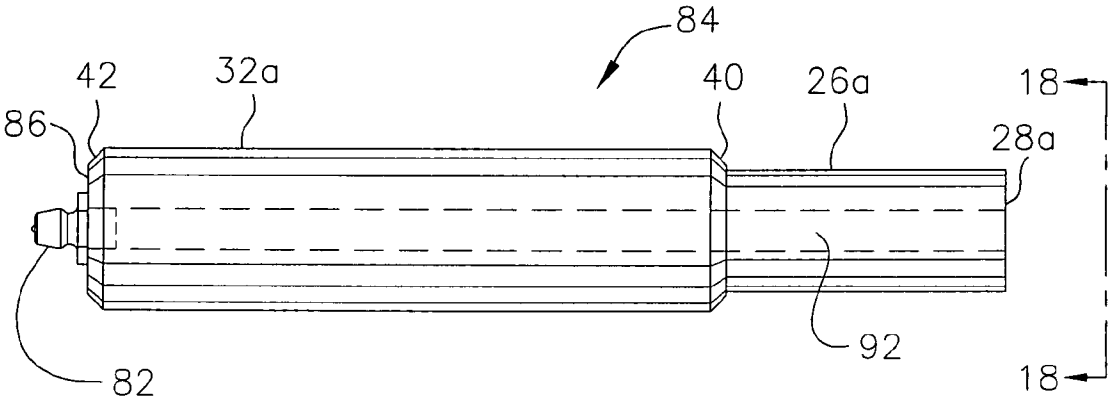
FIG. 17 is a partially exposed side view of the male portions of the three-piece barrel hinge of FIGS. 14-16

FIG. 14 is an exploded perspective view of a third exemplary embodiment of a three-piece barrel hinge 80 of the invention. FIG. 15 is a perspective view, FIG. 16 is a cross-sectional side view of the assembled three-piece barrel hinge 80, FIG. 17 is a cross-sectional side view of the male portions of the three-piece barrel hinge of FIGS. 14-16, and FIG. 18 is an end view of the male portion of the three-piece barrel hinge of FIG. 16 along view lines 18-18. The third exemplary embodiment of a three-piece barrel hinge 80 is similar to the embodiment shown in FIGS. 9-13, but instead of locating a grease fitting on a side wall of the male barrel portions 84*a*, 84*b*, a single grease fitting 86 can be engaged (e.g. threaded, press fit, etc.) with an aperture 88 on an end wall 90 of one of the male barrel portion 84*a*, with a channel 92 extending longitudinally down the male barrel portion 84*a* and exiting at its end 94. The female barrel portion 82 with a central opening 92 is shown. Bevels 40 are formed on the male barrel portions 96 in the transition area between the pin extension portions 26*a,b* and outer surface 32*a,b* thereof. Bevels 42 are also found on the wider end of the male barrel portions 84*a*. The female barrel portion 82 is as described with reference to the prior embodiments. While a single grease fitting is shown on one of the two male barrel portions, both male barrel portions could be fitted with grease fittings.

In the design of the invention, since there will be better lubrication at the points of motion, the tolerances between the pin extensions and the interior diameter of the female barrel can be made closer, thereby providing a more precise and smooth operating hinge.

While in practice there may be grease fittings available that do not have any portions which extend downwardly beyond inside wall 16 of female barrel, the provision of a cavity 36 is highly beneficial as a grease reservoir.

The three-piece barrel hinge design of the invention provides further advantages. For example, unlike prior art designs, only the female barrel need be assembled from seamless tubing which is less expensive than seamed tubing.

Male barrels can be simply machined from round stock and the diameter of pin extensions can be machined to be within whatever tolerances are desired of the interior diameter of female barrels. Furthermore, there is no welding required of a central pin which would otherwise be required to go through all three barrels of the prior art barrel hinge. This means that there is no welding required prior to attachment of the three piece barrel hinge to a trailer or other structure.

In addition to forming the male barrel portions from bar stocks, the male barrel portions can alternately be formed with thick walled tubing, with the pin extensions being machine downed to fit within the axial bore, and with plugs or caps preferably inserted into the bases of the pin extensions.

Having thus described the exemplary embodiments of the present invention, it should be understood by those skilled in the art that the above disclosures are exemplary only and that various other alternatives, adaptations, and modifications may be made within the scope of the present invention. The presently disclosed embodiment is to be considered in all respects as illustrative and not restrictive. The scope of the invention being indicated by the appended claims rather than the foregoing description, and all changes which come within the meaning and range of equivalency of the claims are, therefore, intended to be embraced therein.

What is claimed is:

1. A weld-on barrel hinge for hinging together a first item and a second item, comprising:

a cylindrical female barrel portion consisting essentially of a cylindrical sidewall with a length, two ends, and an outside surface, and an axial bore, the axial bore extending from end to end, wherein the cylindrical sidewall of the cylindrical female barrel portion is adapted for welding in place to the first item;

a first and second male barrel portion, each male barrel portion consisting essentially of a generally cylindrical main body portion with an outer wall surface and an end wall at one end and a pin extension that extends from another end, the pin extension having a pin length, a pin diameter and a cylindrical side wall, each pin extension having an end wall, the pin diameter being sized to be rotatably received within the axial bore of the female barrel portion, wherein a passageway is formed in at least one of the first and second male barrel portions, the passageway having a first end that opens in the cylindrical main body portion, and at least one second end that opens in the pin extension, wherein the outer wall surfaces of the cylindrical main body portions of the first and second male barrel portions are welded directly in place to the second item with the pin extension received in the female barrel portion; and a lubricant fitting affixed to first end of the passageway in the cylindrical main body portion of the least one of the first and second male barrel portions.

2. The weld-on barrel hinge of claim 1, wherein the first end of the passageway formed in at least one of the first and second male barrel portions opens on the end wall of the cylindrical main body portion.

3. The weld-on barrel hinge of claim 1, wherein the first end of the passageway formed in at least one of the first and second male barrel portions opens on the outer wall surface of the cylindrical main body portion.

4. The weld-on barrel hinge of claim 1, wherein the at least one second end of the passageway opens on the end wall of the pin extension.

5. The weld-on barrel hinge of claim 1, wherein the at least one second end of the passageway comprises a plurality of passageways the open on the cylindrical side wall of the pin extension.

6. The weld-on barrel hinge of claim 1, wherein the sum of the pin lengths of the pin extensions of the first and second male barrel portions is less than the length of the axial bore of the female barrel portion, such that when the pin extensions of the first and second male barrel portion are fully inserted into the axial bore of the female barrel portion, a cavity is defined by the space between the ends of the first and second pin extensions and the axial bore and is available as a reservoir for lubricant.

7. The weld-on barrel hinge of claim 1, wherein the two ends of the female barrel portion are outwardly beveled where the outside surface meets the two ends, and wherein the main body portions of the male barrel portions are outwardly beveled where the pin extensions extend therefrom to form a groove in interface regions where the bevels at the two ends of the female barrel portion are adjacent to bevels where the pin extensions extend from the main body portions.

8. The weld-on barrel hinge of claim 1, wherein the first end of the passageway is threaded and the lubricant fitting is threadably engaged therewith.

9. The weld-on barrel hinge of claim 1, wherein the female barrel portion comprises a section of seamless cylindrical tubing.

10. The weld-on barrel hinge of claim 1, wherein each of the male barrel portions is formed from a section of solid cylindrical stock with the pin extension portions machined at one end thereof.

11. The weld-on barrel hinge of claim 1, wherein the first and second male barrel portions are identical.

12. A weld-on barrel hinge for hinging together a first item and a second item, comprising:

a cylindrical female barrel portion consisting essentially of a cylindrical sidewall with a length, two ends, and an outside surface, and an axial bore, the axial bore extending from end to end, wherein the cylindrical sidewall of the cylindrical female barrel portion is adapted for welding in place to the first item;

a first and second male barrel portion, each male barrel portion consisting essentially of a generally cylindrical main body portion with an outer wall surface and an end wall at one end and a pin extension that extends from another end, the pin extension having a pin length, a pin diameter and a cylindrical side wall, each pin extension having an end wall, the pin diameter being sized to be rotatably received within the axial bore of the female barrel portion, wherein a passageway is formed in at least one of the first and second male barrel portions, the passageway having a first end that opens in the cylindrical main body portion, and at least one second end that opens in the end wall of the pin extension, wherein the sum of the pin lengths of the pin extensions of the first and second male barrel portions is less than the length of the axial bore of the female barrel portion, such that when the pin extensions of the first and second male barrel portion are fully inserted into the axial bore of the female barrel portion a cavity is defined by the space between the ends of the first and second pin extensions and the axial bore, and wherein the outer wall surfaces of the cylindrical main body portions of the first and second male barrel portions are welded directly in place to the second item with the pin extension received in the female barrel portion; and a lubricant fitting affixed to the first end of the passageway in the cylindrical main body portion of the least one of the first and second male barrel portions.

13. The weld-on barrel hinge of claim 12, wherein the first end of the passageway formed in at least one of the first and second male barrel portions opens on the end wall of the cylindrical main body portion.

14. The weld-on barrel hinge of claim 12, wherein the first end of the passageway formed in at least one of the first and second male barrel portions opens on the outer wall surface of the cylindrical main body portion.

15. The weld-on barrel hinge of claim 12, wherein the first and second male barrel portions are identical.

16. A weld-on barrel hinge for hinging together a first item and a second item, comprising:

a cylindrical female barrel portion consisting essentially of a cylindrical sidewall with a length, two ends, and an outside surface, and an axial bore, the axial bore extending from end to end, wherein the cylindrical sidewall of the cylindrical female barrel portion is adapted for welding in place to the first item;

a first and second male barrel portion, each male barrel portion consisting essentially of a generally cylindrical main body portion with an outer wall surface and an end wall at one end and a pin extension that extends from another end, the pin extension having a pin length, a pin diameter and a cylindrical side wall, each pin extension having an end wall, the pin diameter being sized to be rotatably received within the axial bore of the female barrel portion, wherein a passageway is formed in the first and second male barrel portions, the passageway having a first end that opens in the cylindrical main body portion, and a plurality of ends that open on the cylindrical side walls of the pin extensions, wherein the outer wall surfaces of the cylindrical main body portions of the first and second portions are welded directly in place to the second item with the pin extension received in the female barrel portion; and a lubricant fitting affixed to first end of the passageway in the cylindrical main body portion of the least one of the first and second male barrel portions.

17. The weld-on barrel hinge of claim 16, wherein the first end of the passageway formed in at least one of the first and second male barrel portions opens on the end wall of the cylindrical main body portion.

18. The weld-on barrel hinge of claim 16, wherein the first end of the passageway formed in at least one of the first and second male barrel portions opens on the outer wall surface of the cylindrical main body portion.

* * * * *